United States Patent [19]

Harbeke

[11] Patent Number: 4,983,330

[45] Date of Patent: Jan. 8, 1991

[54] MEMBRANE CARBURETOR HAVING A COUPLING ARRANGEMENT FOR COUPLING THE CHOKE AND THROTTLE FLAPS TO EACH OTHER

[75] Inventor: Jög Harbeke, Waiblingen-Beinstein, Fed. Rep. of Germany

[73] Assignee: Andreas Stihl, Waiblingen, Fed. Rep. of Germany

[21] Appl. No.: 453,961

[22] Filed: Dec. 20, 1989

[30] Foreign Application Priority Data

Dec. 21, 1988 [DE] Fed. Rep. of Germany ..... 3842974

[51] Int. Cl.[5] ..... F02M 1/02

[52] U.S. Cl. ..... 261/52

[58] Field of Search ..... 261/52

[56] References Cited

U.S. PATENT DOCUMENTS

| | | | |
|---|---|---|---|
| 2,082,710 | 6/1937 | Mallory | 261/52 |
| 2,198,676 | 4/1940 | Mallory | 261/52 |
| 3,342,465 | 9/1957 | Szwargulski et al. | 261/52 |
| 3,575,389 | 4/1971 | Goto et al. | 261/52 |
| 3,669,636 | 6/1972 | Garretson et al. | 261/52 |
| 3,886,917 | 6/1975 | Nakada et al. | 261/52 |
| 4,123,480 | 10/1978 | Johansson | 261/52 |
| 4,351,782 | 9/1982 | Bellicardi et al. | 261/52 |
| 4,439,377 | 3/1984 | Nartowski | 261/52 |
| 4,672,929 | 6/1987 | Wissmann et al. | 261/52 |

*Primary Examiner*—Tim Miles

*Attorney, Agent, or Firm*—Walter Ottesen

[57] ABSTRACT

The invention is directed to a membrane carburetor having an intake channel and a choke flap and throttle flap movably mounted in this channel one behind the other when viewed in the direction of flow through the channel. The choke flap is arranged in the intake channel for enriching the mixture for a cold start. The choke flap is pivoted into an out-of-service position so that the choke flap is fully opened after start and after the engine is running and has warmed. The membrane carburetor is as a rule tuned for the idle condition and for the full-load condition. However, relatively lean mixtures can form in the part-load region which can lead to a non-quiet running of the engine and possibly to engine damage. According to the invention, the throttle flap is coupled to the choke flap via a four-rod linkage for achieving a mixture enrichment in the part-load region of the engine. The choke flap is pivotable independently of the choke flap position predetermined by the linkage for the start position.

10 Claims, 2 Drawing Sheets

Fig. 1
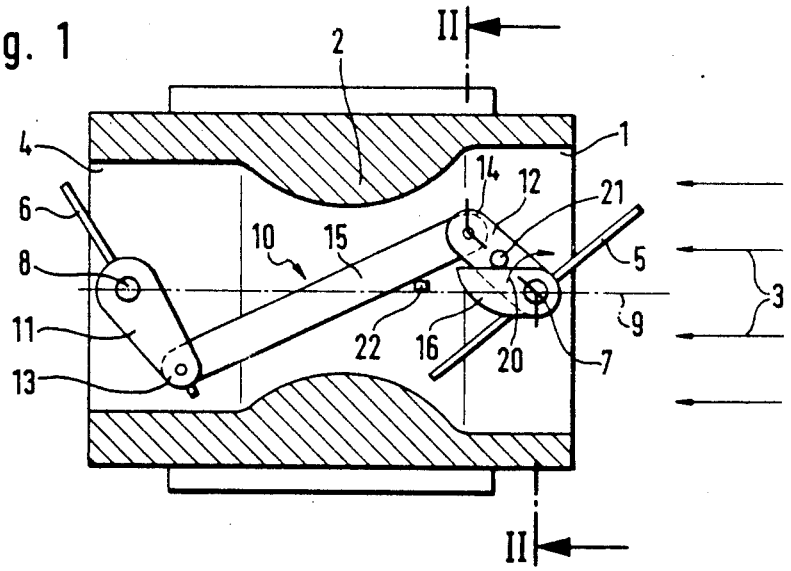
Fig. 2
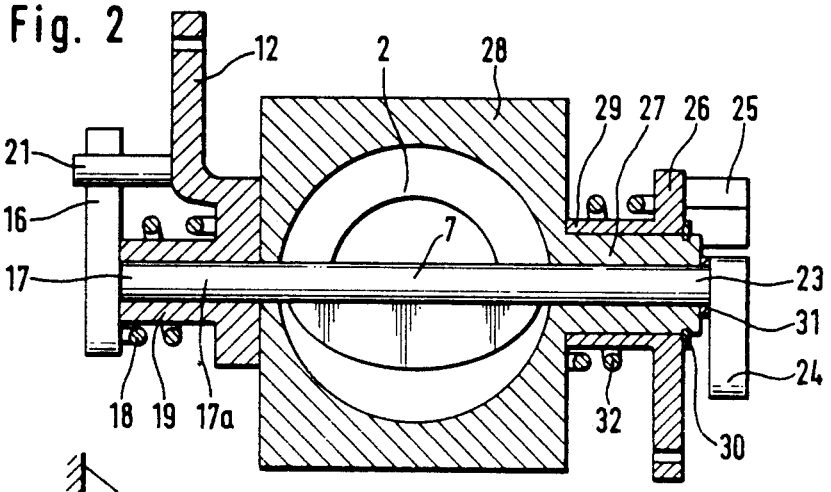
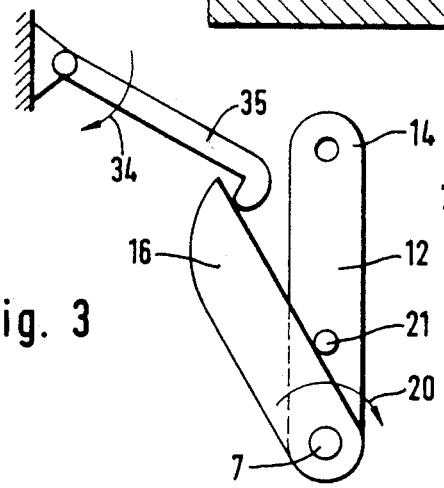
Fig. 3
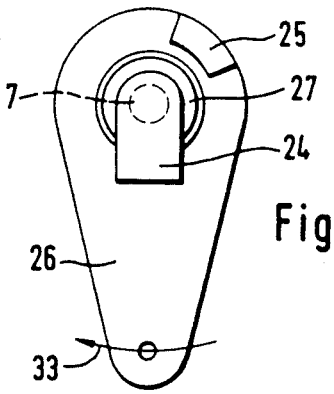
Fig. 4

MEMBRANE CARBURETOR HAVING A COUPLING ARRANGEMENT FOR COUPLING THE CHOKE AND THROTTLE FLAPS TO EACH OTHER

FIELD OF THE INVENTION

The membrane carburetor has an intake channel and a choke flap and a throttle flap which are movably mounted in this channel one behind the other when viewed in the direction of flow through the channel. A kinematic coupling arrangement position-dependently couples the two flaps with each other in such a manner that in the start position, the choke flap is closed and the throttle flap is partially open, and in the full-throttle position, both flaps are completely open.

BACKGROUND OF THE INVENTION

Carburetors of this kind are generally known and are usually utilized in motor chain saws. In the cold start position, the choke flap is closed and the throttle flap is partially open; whereas, in the full-throttle position, the choke flap as well as the throttle flap are fully open. For a warm running engine, the choke flap is always held in its out-of-service position which can be achieved by means of a manual positioning member or a partially-automatic positioning member.

Membrane carburetors of this kind are as a rule tuned in their idle position and in their full-throttle position for adjusting the air/fuel mixture. This can lead to the condition that a relatively lean mixture is made available by the membrane carburetor in the part-load region of the internal combustion engine and this leads to a poor running performance of the engine. In two-stroke engines, the lubrication occurs via the two-stroke oil mixed in with the fuel. In such engines, a mixture which is too lean can furthermore lead to engine damage with a complete loss of the engine resulting therefrom. Lean mixtures further lead to temperature increases which can lead to temperature damage in the engine.

Structural measures such as additional bores or the like can be used to tune the membrane carburetor in the part-load range. However, this leads to an overenrichment of the mixture when running down from a high rpm to a lower rpm whereby the engine can die.

SUMMARY OF THE INVENTION

It is an object of the invention to tune a membrane carburetor for the engine of a portable handheld work tool over the entire load range of the engine in such a manner that an unwanted leaning of the mixture is avoided.

The carburetor of the invention is for an internal combustion engine of a portable handheld tool such as a motor chain saw, brushcutter or the like, the engine being operable in an idle running condition, in a part load range and in a full-throttle running condition. The carburetor includes: an intake channel through which air flows to the engine; a choke flap movably mounted in the intake channel so as to be movable between a full choke position wherein the choke flap substantially closes the channel and a no-choke position wherein the choke flap fully opens the channel; a throttle flap mounted in the intake channel in spaced relationship to the choke flap measured in the direction of the air flow through the channel, the throttle flap being movable between a first position corresponding to the idle running condition of the engine and a second position corresponding to the full-throttle running condition of the engine; kinematic linkage means for position-dependently connecting the flaps to each other and being movable from a start position wherein the throttle flap is in a part-open position between the first and second positions and the choke flap is in the full-choke position to a full throttle position wherein the choke flap is in the no-choke position and said throttle flap is in said second position; the kinematic linkage means also being movable for adjusting the position of the choke flap to correspond to the position of the throttle flap when the engine operates in the part-load range; and, actuation means for pivoting the choke flap independently of its position predetermined by the linkage means so as to bring the choke flap into the full-choke position.

A metered enrichment of the mixture is obtained by using the choke flap for enriching the mixture in the part-load range of the engine whereby the engine reaches a high degree of quiet running and engine damage because of excessive increases in temperature or a seizure of the piston is reliably avoided. In the part-load region, the linkage adjusts the choke flap corresponding to the position of the throttle flap so that the choke flap follows the throttle flap. According to the invention, the enrichment of the mixture takes place especially in the lower and mid part-load regions by means of a corresponding positioning of the choke flap. In the upper part-load region, the choke flap is held horizontally in an out-of-service position so that the composition of the mixture is exclusively determined by means of the throttle flap.

According to a further embodiment of the invention, a linkage in the form of a four-rod linkage is provided which includes the following: a crank lever attached to the throttle flap shaft; a swing lever mounted on the choke flap shaft; and, a coupling rod connecting the free end of the crank lever to the free end of the swing lever. A linkage of this kind is maintenance free and can be assembled in a simple manner A fixed transmission ratio can be determined by selecting the lever arm length of the swing lever, coupling rod and crank lever. In this manner, a transmission ratio which changes especially in dependence upon angular position can also be determined.

BRIEF DESCRIPTION OF THE DRAWINGS

The invention will now be described with reference to the drawings wherein:

FIG. 1 is a section view taken through the intake channel of a membrane carburetor and showing an embodiment of the linkage coupling the choke and throttle flaps to each other;

FIG. 2 is a section view taken along line II—II of FIG. 1 through the intake channel and shows the mounting arrangement for the choke flap;

FIG. 3 is an end elevation view showing the linkage end of the choke flap shaft;

FIG. 4 is a side elevation view showing the end of the choke flap shaft facing away from the linkage;

DESCRIPTION OF THE PREFERRED EMBODIMENTS OF THE INVENTION

Figure 5:
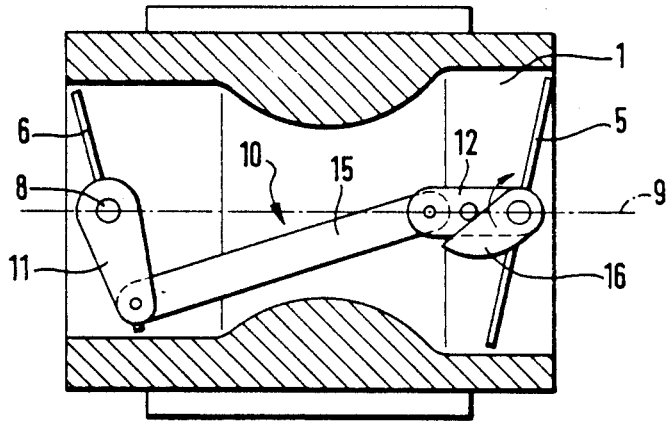
FIG. 5 is a section view taken through the intake channel of the membrane carburetor according to FIG. 1 wherein the choke flap and throttle flap are shown in the idle position.

The intake channel 1 is shown in section in FIG. 1 and includes a venturi section 2. In this region, an underpressure develops for drawing in the fuel by suction from the membrane carburetor which is not shown in greater detail The combustion air flows into the intake channel 1 in the direction of arrow 3 and mixes with the fuel metered into the venturi section 2. Thereafter, the air and fuel is directed as an air/fuel mixture to the output 4 of the intake channel 1 and into the combustion chamber of an internal combustion engine not shown in greater detail and this engine is preferably a two-stroke engine The engine is utilized as the drive engine of a portable handheld motor chain saw or of a brushcutter or of a cutoff machine or the like. An application of the engine for lawn mowers or other hand-guided machines is also purposeful.

A choke flap 5 and a throttle flap 6 are arranged one behind the other in the flow path of the intake channel 1. The choke flap 5 is mounted upstream of the venturi section 2 and the throttle flap 6 is mounted downstream of the venturi section 2. The choke flap and throttle flap are rotatably journalled in the intake channel 1 with respective shafts 7 and 8 with the shafts 7 and 8 being parallel to each other and at right angles to the longitudinal center axis of the intake channel 1.

In the embodiment shown, the choke flap shaft 7 and the throttle flap shaft 8 are position-dependently coupled to each other via a four-rod linkage 10. The four-rod linkage 10 comprises a crank lever 11 attached to the throttle flap shaft 8 so as to rotate therewith and a swing lever 12 mounted on the choke flap shaft 7 so as to rotate with respect thereto. The respective free ends (13 and 14) of the crank lever 11 and swing lever 12 are connected to each other via a pivotally-connected coupling rod 15.

The end 17 of the choke flap shaft 7 projects out from the swing lever 12 at the end of the linkage 10 A cam 16 is fixedly mounted to the end 17 of the choke flap 7 so as to rotate therewith. A torsion spring 18 configured as a leg spring is mounted between the cam 16 and the swing lever 12. The torsion spring 18 preferably lies on a cylindrical projection 19 of the spring lever 12 and this projection 19 is seated on the end portion 17*a* of the choke flap shaft 7 and simultaneously guarantees a tilt-safe journalling of the swing lever 12 on the choke flap shaft 7. The torsion spring 18 is fixed with one end to the swing lever 12 and engages the cam 16 with its other end. The torsion spring 18 is so pretensioned that it imparts a positioning force to the cam 16 and thereby to the choke flap 5 in its open position (FIG. 6) with the positioning force acting in the direction of arrow 20 (FIG. 1). The spring can also be mounted between the cam 16 and the housing in order to achieve this positioning force. The positioning force effects the condition that the cam 16 is held in contact engagement with a stop 21 provided on the swing lever 12 so that the choke flap shaft 7 is drive connected to the four-rod linkage 10 via the torsion spring 18. FIG. 3 is an enlarged schematic showing the force-transmitting contact engagement of the cam 16 against the stop 21 of the swing lever 12.

A further cam 24 is arranged at the other end 23 of the choke flap shaft 7. This cam 24 likewise projects radially into the rotational region of a stop 25 (FIG. 4). The stop 25 is attached to the choke lever 26 or is configured as one piece therewith. The choke lever 26 is rotatably held on the cylindrical bearing projection 27 of the housing 28 of the membrane carburetor. The choke lever 26 has a cylindrical bearing sleeve 29 formed as a single piece therewith for obtaining a journalling of the choke lever which is secure against tilting. The choke lever 26 is securely held on the bearing projection 27 by means of a retainer ring 30 in such a manner that it cannot separate therefrom.

In the embodiment shown, the choke flap shaft 7 is axially secured by means of the cams 16 and 24 mounted at the respective ends 17 and 23 and an intermediate disc 31 can be mounted between the cam 24 and the axial end of the bearing projection 27. A torsion spring 32 is arranged between the choke lever 26 and the housing 28 and this spring can likewise be configured as a leg spring. The choke lever 26 is resiliently biased into its out-of-service position by means of the torsion spring 32. For this purpose, the leg spring is connected at one end to the housing 28 so that it cannot rotate with respect thereto and at its other end, the spring is connected to the choke lever 26 so that it cannot rotate with respect to the latter.

A mixture enrichment of the air/fuel mixture in the part-load region is obtained by means of the coupling of the invention between the throttle flap 6 and the choke flap 5. Such a part-load position of the membrane carburetor is shown in FIG. 1. The throttle flap 6 is pivoted into the position shown by means of a positioning member not shown in greater detail. In this position, the stop 21 is likewise pivoted into a corresponding rotational position because of the coupling via the coupling rod 15 and the swing lever 12 because of the acting torsion spring 18, the cam 16 lies against the stop 21 whereby the choke flap 5 is pivoted into an open but active position. The mixture is enriched.

If the throttle flap 6 is pivoted out of the part-load position shown in FIG. 1 and into the idle position shown in FIG. 5, then the choke flap 5 follows correspondingly in the opposite rotational direction because of the four-rod linkage 10. In this idle position, the swing lever 12 lies in the same axial position as the longitudinal center axis of the intake channel 1 and in the direction toward the throttle flap shaft 8. The crank lever 11 then lies almost at right angles to the longitudinal center axis 9.

Figure 6:
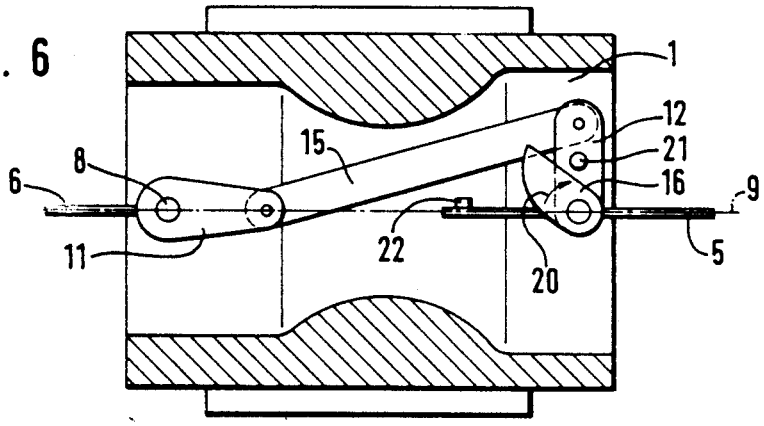
FIG. 6 corresponds to FIG. 5 but with the choke flap and throttle flap disposed in the full-throttle position; and, FIG. 7 corresponds to FIG. 5 and shows the choke flap and throttle flap lying in the cold-start position.

If the throttle flap 6 is pivoted into the full-load position shown in FIG. 6, the throttle flap 6 as well as the choke flap 5 are fully opened. The linkage 10 is so configured that the choke flap 5 is already pivoted into its full-open position in the upper part-load region. This position is determined by the stop 22.

In the range between the upper part-load region and the full-load position, the stop 21 lifts away from the cam 16 which is possible because of the resilient connection between the cam 16 and the swing lever 12. In the full-load position shown in FIG. 6, the crank lever 11 lies with its axis in the same direction as the longitudinal center axis 9 of the intake channel 1 and the swing lever 12 is approximately at right angles to this longitudinal center axis 9.

Figure 7:
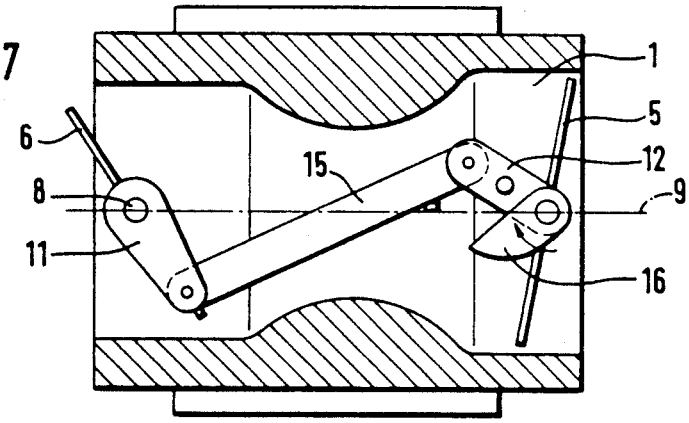

For a cold start, the choke lever 26 is pivoted by means connected to the distal end of lever 26 in arrow direction 33 (FIG. 4) whereby the cam 24 is taken along in the same direction 33 via the stop 25. The choke flap shaft 7 pivots opposite to the arrow direction 20 into the start position shown in FIG. 7 with the cam 16 being lifted from the stop 21 against the force of the torsion spring 18. Even if the throttle flap 6 is now displaced and the stop 21 is pivoted through a corresponding angular region via the linkage 10, this has no effect on the position of the choke flap 5 since the closed position thereof is determined exclusively by the rotational position of the choke lever 26, that is, by its stop 25. The relative movement between the swing lever 12 and the cam 16 of the choke flap shaft 7 is taken up by the torsion spring 18.

A mixture enrichment is achieved especially in part-load operation by means of coupling of the throttle flap position and choke flap position independently of a use of the choke flap for a cold start. This provides excellent running performance of the engine and counters engine damage by means of the occurrence of a mixture which is too lean. In this context, and for tuning the choke flap position over the part-load range, the linkage has a fixed transmission ratio or can preferably have a transmission ratio which changes with angular position whereby a sensitive tuning of the mixture is possible.

In addition to the four-rod linkage shown in the embodiments, a gear transmission, friction wheel transmission or idler-pulley drive and especially a cam-disc linkage can be used.

In the embodiment shown, the lever arm of the crank 11 is somewhat larger than the lever arm of the swing lever 12. It can be advantageous to provide the lever arms with greatly different lengths in correspondence to the desired transmission ratio.

The choke flap 5 and the throttle flap 6 of the carburetor shown pivot with their respective shafts 7 and 8 in different rotational directions. The coupling transmission can be correspondingly configured for a carburetor having a throttle flap and choke flap pivoting in the same rotational direction.

Practicing the invention, a pivotable manipulator 35 can be arranged at the end of the linkage 10 for the cold start of the choke flap in lieu of the positioning device arranged at the end 25 of the choke flap shaft 7. If this manipulator 35 is pivoted in the direction of arrow 34, then its free end enters the positioning path of the cam 16 and takes the cam 16 along against the force of spring 18 in a direction opposite to arrow 20 so that the choke flap 5 can be pivoted into its cold start position shown in FIG. 7 independently of the position of the throttle flap 6.

It is understood that the foregoing description is that of the preferred embodiments of the invention and that various changes and modifications may be made thereto without departing from the spirit and scope of the invention as defined in the appended claims.

What is claimed is:

1. A carburetor for an internal combustion engine of a portable handheld tool such as a motor chain saw, brushcutter or the like, the engine being operable in an idle running condition, in a part load range and in a full-throttle running condition, the carburetor comprising:

an intake channel through which air flows to the engine;

a choke flap movably mounted in said intake channel so as to be movable between a full choke position wherein said choke flap substantially closes said channel and a no-choke position wherein the choke flap fully opens said channel;

a throttle flap mounted in said intake channel in spaced relationship to said choke flap measured in the direction of the air flow through said channel, said throttle flap being movable between a first position corresponding to the idle running condition of the engine and a second position corresponding to the full-throttle running condition of the engine;

kinematic linkage means for position-dependently connecting said flaps to each other and being movable from a start position wherein said throttle flap is in a part-open position between said first and second positions and said choke flap is in said full-choke position to a full-throttle position wherein said choke flap is in said no-choke position and said throttle flap is in said second position;

said kinematic linkage means also being movable for adjusting the position of said choke flap to correspond to the position of said throttle flap when the engine operates in said part-load range;

actuation means for pivoting said choke flap independently of its position predetermined by said linkage means so as to bring said choke flap into said full-choke position; and, said linkage means including: resilient biasing means for pivotally biasing said choke flap through a positioning path into said no-choke position; and, stop means arranged in said positioning path for drive-connecting said choke flap to said linkage means via said resilient means.

2. The carburetor of claim 1, said resilient biasing means including a spring for pivotally biasing said choke flap into said no-choke position, said spring having respective ends and being braced against said choke flap at one of said ends; and, first cam means for engaging said stop means and the other end of said spring being braced against said first cam means whereby said first cam means is held against said stop means to drivingly connect said choke flap to said linkage means.

3. The carburetor of claim 2, comprising manually actuable means mounted next to said linkage means for engaging and acting on said first cam means for pivoting said choke flap into said full-choke position.

4. The carburetor of claim 2, said actuation means including second cam means for acting on said choke flap to pivot said choke flap into said full-choke position against the force of said resilient biasing means.

5. The carburetor of claim 4, said choke flap having a choke shaft for pivotally mounting said choke flap in said intake channel and said choke shaft having first and second ends; said linkage means including a first lever pivotally mounted on one of said ends of said choke shaft and said second cam means being fixedly attached to the other end of said choke shaft; and, said stop means being mounted on said first lever.

6. The carburetor of claim 5, said throttle flap having a throttle flap shaft; and, said linkage means being a four-lever linkage including: said first lever as a swing lever pivotally mounted on said choke flap shaft so as to pivot relative thereto and said swing lever having a free end; a crank lever attached to said throttle flap shaft and having an outer free end; and, a coupling rod connecting said free end of said swing lever to said outer free end of said crank lever.

7. The carburetor of claim 6, said intake channel defining a longitudinal axis; said crank lever and said swing lever being pivotally interconnected so as to cause said crank lever to lie parallel to said axis and said swing lever to be at right angles to said axis when the engine is in said full-throttle running condition.

8. The carburetor of claim 7, said crank lever and said swing lever each having approximately the same length.

9. The carburetor of claim 6, comprising ancillary stop means for receiving said choke flap in contact engagement therewith so as to determine said no-choke position in the upper part-load range of the engine.

10. The carburetor of claim 6, said linkage means having a transmission ratio which changes in dependence upon the rotational position of one of said shafts.

* * * * *

UNITED STATES PATENT AND TRADEMARK OFFICE

CERTIFICATE OF CORRECTION

PATENT NO. : 4,983,330

DATED : January 8, 1991

INVENTOR(S) : Jörg Harbeke

It is certified that error appears in the above-identified patent and that said Letters Patent is hereby corrected as shown below:

On the title page, under column 1, reference numeral [75], please delete "Jög Harbeke" and substitute -- Jörg Harbeke -- therefor.

On the title page, column 1, Under "U.S. PATENT DOCUMENTS", line 3, please delete "1957" and substitute -- 1967 -- therefor.

In column 2, line 40: between "manner" and "A" insert -- . --.

In column 3, line 10: between "detail" and "The" insert -- . --.

In column 3, line 17: between "engine" and "The" insert -- . --.

In column 3, line 42: between "linkage 10" and "A" insert -- . --.

In column 4, line 35: delete "lever 12 because" and substitute -- lever 12. Because --therefor.

Signed and Sealed this

Twelfth Day of May, 1992

*Attest:*

DOUGLAS B. COMER

*Attesting Officer*

*Acting Commissioner of Patents and Trademarks*